US006225954B1

(12) United States Patent
Edvardsson et al.

(10) Patent No.: US 6,225,954 B1
(45) Date of Patent: May 1, 2001

(54) INTEGRATED ANTENNA MEANS FOR A MOTOR VEHICLE COMPRISING REFLECTOR

(75) Inventors: Olov Edvardsson; Mattias Hellgren, both of Täby (SE)

(73) Assignee: SMARTEQ Wireless AB, Enebyberg (SE)

( * ) Notice: Subject to any disclaimer, the term of this patent is extended or adjusted under 35 U.S.C. 154(b) by 0 days.

(21) Appl. No.: 09/327,175

(22) Filed: Jun. 7, 1999

(30) Foreign Application Priority Data

Jun. 5, 1998 (SE) ..... 9802010

(51) Int. Cl.[7] ..... H01Q 1/32
(52) U.S. Cl. ..... 343/713; 343/711; 343/712
(58) Field of Search ..... 343/713, 715, 343/711, 712, 895; H01Q 1/32

(56) References Cited

U.S. PATENT DOCUMENTS 4,229,744 * 10/1980 Luedtke et al. ..... 343/769
5,649,316 * 7/1997 Prudhomme et al. ..... 455/345
6,024,382 * 2/2000 Baumann ..... 280/801.1

FOREIGN PATENT DOCUMENTS 4403643 8/1995 (DE) .
19530617 2/1997 (DE) .
19616974 10/1997 (DE) .

* cited by examiner

*Primary Examiner*—Hoanganh Le
(74) *Attorney, Agent, or Firm*—Jacobson, Price, Holman & Stern, PLLC

(57) ABSTRACT

The main object of the present invention is to provide a wide band antenna device integrated in a vehicle (101) for receiving and transmitting RF signals, without transmitting electromagnetic radiation into the compartment of the vehicle. This is achieved by providing a housing (104) being transparent to RF radiation in at least one direction. The housing being arranged inside the compartment (105) of the vehicle. The housing comprising means for suppressing RF radiation in substantially all directions facing substantially inwards the compartment of the motor vehicle seen from a radiating element (201) being arranged in the housing.

13 Claims, 4 Drawing Sheets

INTEGRATED ANTENNA MEANS FOR A MOTOR VEHICLE COMPRISING REFLECTOR

TECHNICAL FIELD OF INVENTION

The present invention relates generally to an antenna means for receiving and transmitting RF signals arranged for being mounted in a vehicle, for instance in a car. More specifically the present invention relates to an antenna means comprising a reflector means for receiving and transmitting RF signals arranged for being mounted in a vehicle.

DESCRIPTION OF RELATED ART

Operating hand-held radio communication devices in a motor vehicle may result in bad performance as the metallic plates in the roof, walls and the floor act as a radiation shield. There is also an increased risk that transmitted RF energy from the hand-held radio communication device may interact with other electronic equipment in the car through EMC (Electro-Magnetic Coupling). Recent research indicates that it would be beneficial to reduce SAR values for radiating equipment operated in a motor vehicle, especially in a car.

All these problems are a result of operating a radiating device inside a metallic cage. The motor vehicle acts as a metallic cage with the driver and passengers inside and the only way out for radiation being substantially through the windows. The electromagnetic radiation is held within the cage reflecting back and forth affecting electronic equipment and persons in the car.

Modern hand-held radio communication devices are capable of transmitting and receiving RF signals in more than one RF band or in a very broad RF band. An antenna device for receiving and transmitting RF signals in multiple bands is disclosed in the Swedish patent application SE-9801169-5 'WIDE BAND ANTENNA MEANS INCORPORATING A RADIATING STRUCTURE HAVING A BAND FORM' assigned to the present assignee and which is hereby incorporated in the present application by reference. It is also a desirable characteristic of an antenna device to be small.

One solution to the problems with EMC in the compartment of a car is to position the radiating device outside the compartment, for instance with a separate antenna. The separate antenna may then be coupled to the hand-held radio communication device and secured, for instance, on the outside of the roof of the motor vehicle. Recent development indicates that car producers prefer to provide new models with antennas integrated in the car assembly. A connection may be provided for connecting the hand-held radio communication device to the integrated antenna.

Such arrangement are shown in, for instance the German gebrauchsmuster DE 296 06 475 which disclose a low profile antenna with a covering ground plane mounted for instance to a window. Such a low profile antenna is not suitable for receiving or transmitting RF signals in a broadband application or in multiple RF bands.

The German gebrauchsmuster DE 296 15 060 disclose radiating elements integrated in parts of a car, such as in a rear light or rear bumpers. No antenna means suitable for transmitting and receiving RF signals in multiple bands are disclosed.

It is beneficial to have the antenna as close as possible to the actual hand-held radio communication device so a minimum loss occur in the transfer of signals between the antenna and the circuitry of the hand-held device. Since the radio communication device is operated by a passenger or driver it would thus be beneficial to have the antenna in the passenger compartment, however this would then, according to the prior art, result in the problems described above.

SUMMARY OF INVENTION

The main object of the present invention is to provide a wide band antenna device integrated in a vehicle for receiving and transmitting RF signals, without transmitting electromagnetic radiation into the compartment of the vehicle.

The problems described, with how to achieve an antenna device for receiving and transmitting RF signals arranged to be mounted on a vehicle comprising an compartment, without transmitting electromagnetic radiation into the compartment of the vehicle and taking a limited amount of space are solved by providing a housing being transparent to RF radiation in at least on direction, the housing being arranged inside the compartment, the housing comprising means for suppressing RF radiation in substantially all directions facing substantially inwards the compartment of the motor vehicle seen from a radiating element being arranged in the housing.

The problems described above, according to a first embodiment of the invention, with how to achieve an antenna device for receiving and transmitting RF signals in multiple bands, which is integrated into a part of a vehicle, and arranged in the passenger compartment, without transmitting electromagnetic radiation into the compartment of the vehicle and taking a limited amount of space are solved by providing an broadband radiating element arranged in a housing, the housing having conductive surfaces on all sides facing substantially inwards the compartment of the motor vehicle seen from the radiating device and, at least one of the conductive surfaces being conductivly or capacitivly connected to a larger metal surface substantially covering at least one side of the compartment.

The housing constitutes a reflector reflecting RF energy, transmitted from the radiating element towards the compartment, outwards to the free air, thus increasing the efficiency of the antenna means as well as reducing the amount of radiation in the compartment of the car.

The problems described above, according to a second embodiment of the invention, are solved by further to the above providing a radiating element having a substantially accordion form.

An advantage with the present invention is that an antenna means integrated into a part of a motor vehicle, which is capable of receiving and transmitting RF signals in multiple bands, is achieved.

Another advantage according to a preferred embodiment of the invention is that the antenna device can be arranged inside the compartment of the vehicle.

Another advantage with the present invention is obtained by positioning the radiating device in a housing, which has conductive surfaces facing inwards the compartment, so that no electromagnetic radiation is transmitted into, and lost in, the compartment effectively eliminating EMC with other electronic equipment and substantially reducing SAR values for driver and passengers.

Yet another advantage with the present invention is that a better gain is achieved since no radiation is transmitted into the compartment.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention and wherein.

DETAILED DESCRIPTION OF PREFERRED EMBODIMENTS

Figure 1:
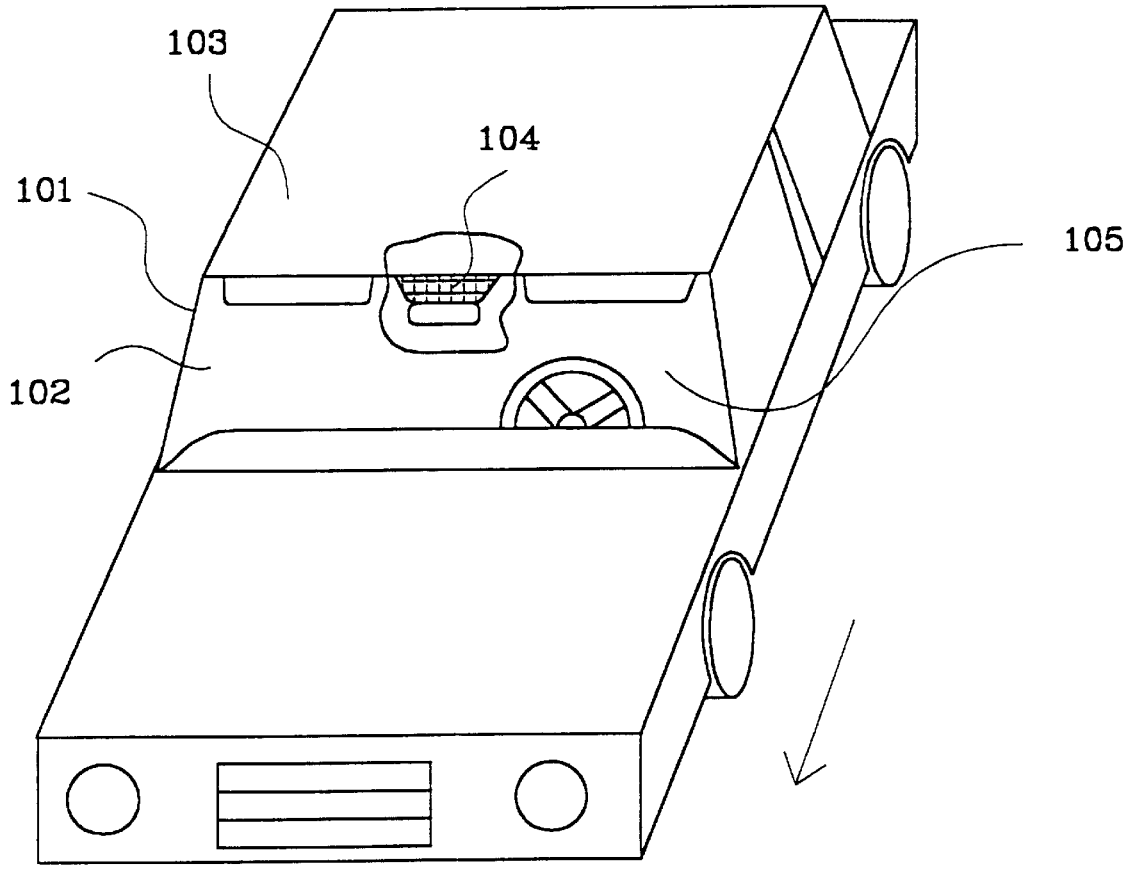
FIG. 1 shows a motor vehicle with the inventive antenna device according to a first embodiment of the invention.

FIG. 1 shows a first embodiment of the invention wherein a motor vehicle is denoted 101 and comprises a front windscreen denoted 102 and a metal roof denoted 103. A box is denoted 104 and is further disclosed in FIG. 2. The box 104 is secured and positioned tightly to the window 102. The part of the box, facing the window is open or made of a dielectric material such as plastic so as to be transparent to RF radiation. The box 104 may comprise control equipment for controlling the electronics of the motor vehicle 101. A transportation, passenger and/or drivers compartment is denoted 105.

Figure 2:
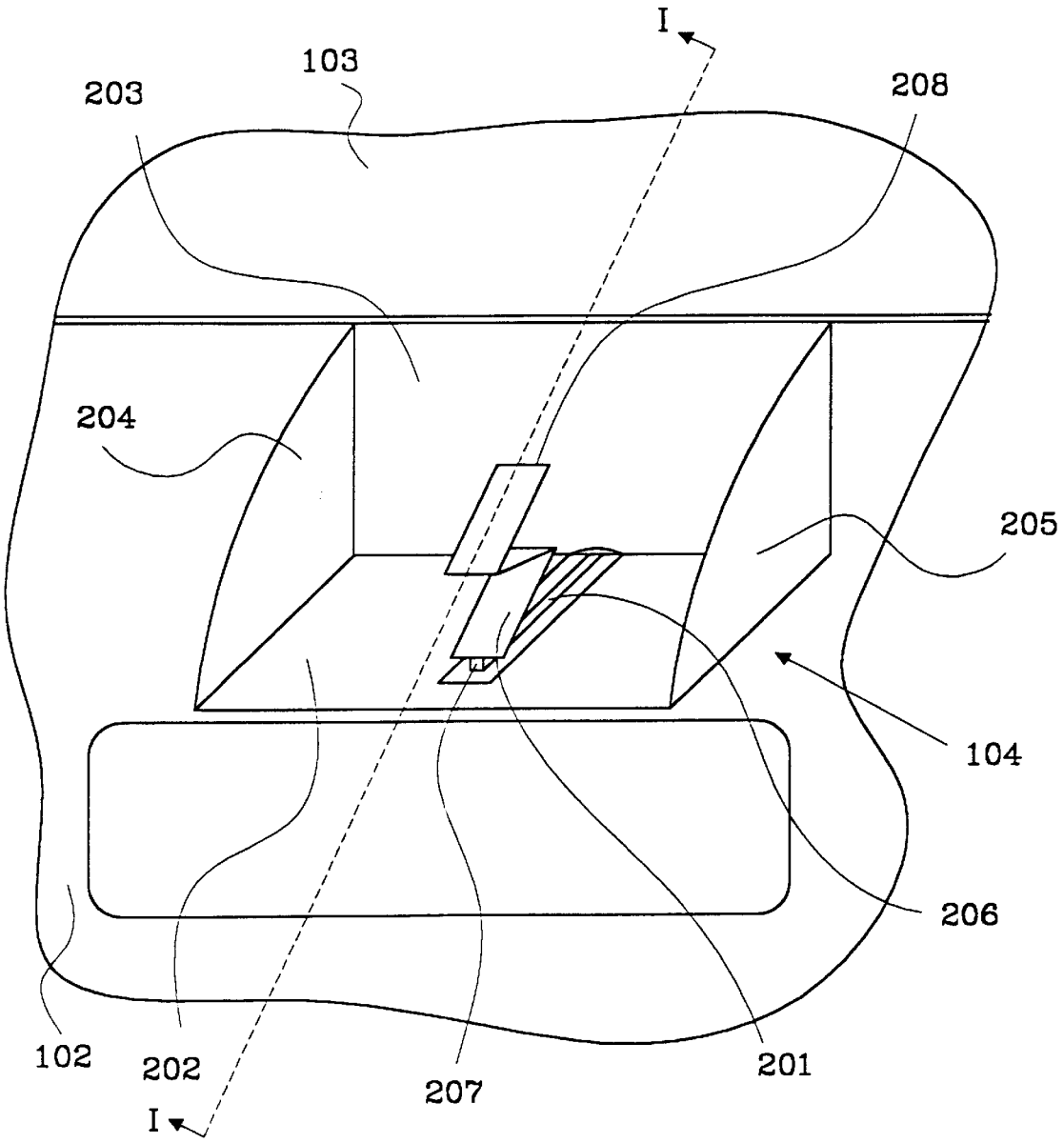
FIG. 2 shows an enlarged view of the inventive antenna device in FIG. 1.

FIG. 2 shows a closer view of the box 104 in FIG. 1. A radiating element is denoted 201 having the form of a band with bends or curves. Such a radiating element is disclosed in the Swedish patent application SE-9801169-5 'WIDE BAND ANTENNA MEANS INCORPORATING A RADIATING STRUCTURE HAVING A BAND FORM' together with many other examples of radiating structures. In the present application only one example of such a radiating element is disclosed even though many variants may fulfil the requirements. It is however important that the radiating element is not too long as this would result in a very big box 104. Therefore a radiating structure having minimum height is required and fulfilled with the radiating element disclosed in the Swedish application SE-9801169-5. A feeding means is denoted 206 and is connected to a feeding portion 207. A free end of the radiating element is denoted 208.

Even though a general box is used in this preferred embodiment the antenna means may of course also be arranged in more specific types of boxes, such as for instance a control box, a rear light etc. in the car.

The box 104 comprises at least a first, second, third and fourth side denoted 202, 203, 204 and 205 respectively. The volume so obtained can preferably be only one part of the complete box and other electronic equipment can be contained in other parts of the box with reduced risk of electromagnetic coupling. The sides being coated with a conductive metal layer on the inside facing the radiating element 201 thus shielding the compartment 105 from electromagnetic radiation radiated from the antenna element 201. Thus, seen from the radiating element 201, substantially all sides facing inwards the compartment 105 comprises a protective layer preventing or at least suppressing RF radiation from entering the passenger compartment. One side may contain a small shaft arranged for receiving a feeding means for feeding the radiating element 201 with RF signals.

The conductive coating is connected to ground and the coating on the sides being connected to each other. In the coating on the first side 202 is a thin slit arranged for feeding, through a feeding means 206, RF signals to the radiating element. It would also be possible to have a coaxial cable, a microstrip or other means for feeding the radiating element 201. The conductive coating on the second side 203 is conductivly coupled along the complete edge to the metal in the roof 103 preventing electromagnetic radiation from leaking into the compartment 105. Alternatively may the conductive coating be capacitivly coupled to the metal of the roof 103.

Figure 3:
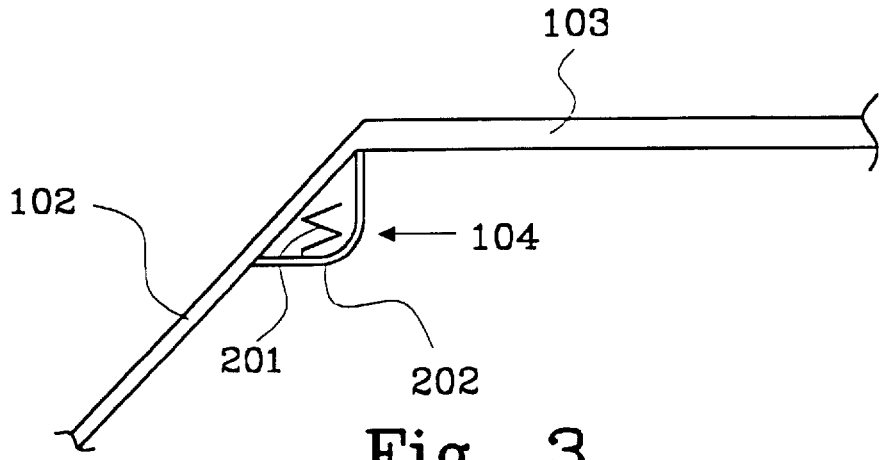
FIG. 3 shows a section of the arrangement in FIG. 2 taken at I—I.

FIG. 3 shows a section of the arrangement of FIG. 2 taken at I—I. It is clearly shown in FIG. 3 that a radiating element 201 which is bent or curved is required to fit the radiating element 201 within the box 104. The side 202 is horizontally arranged and the radiating element 201 is arranged vertically. As is also shown in FIG. 3 the corners and edges of the housing might be softly rounded and not necessarily sharp.

Figure 4:
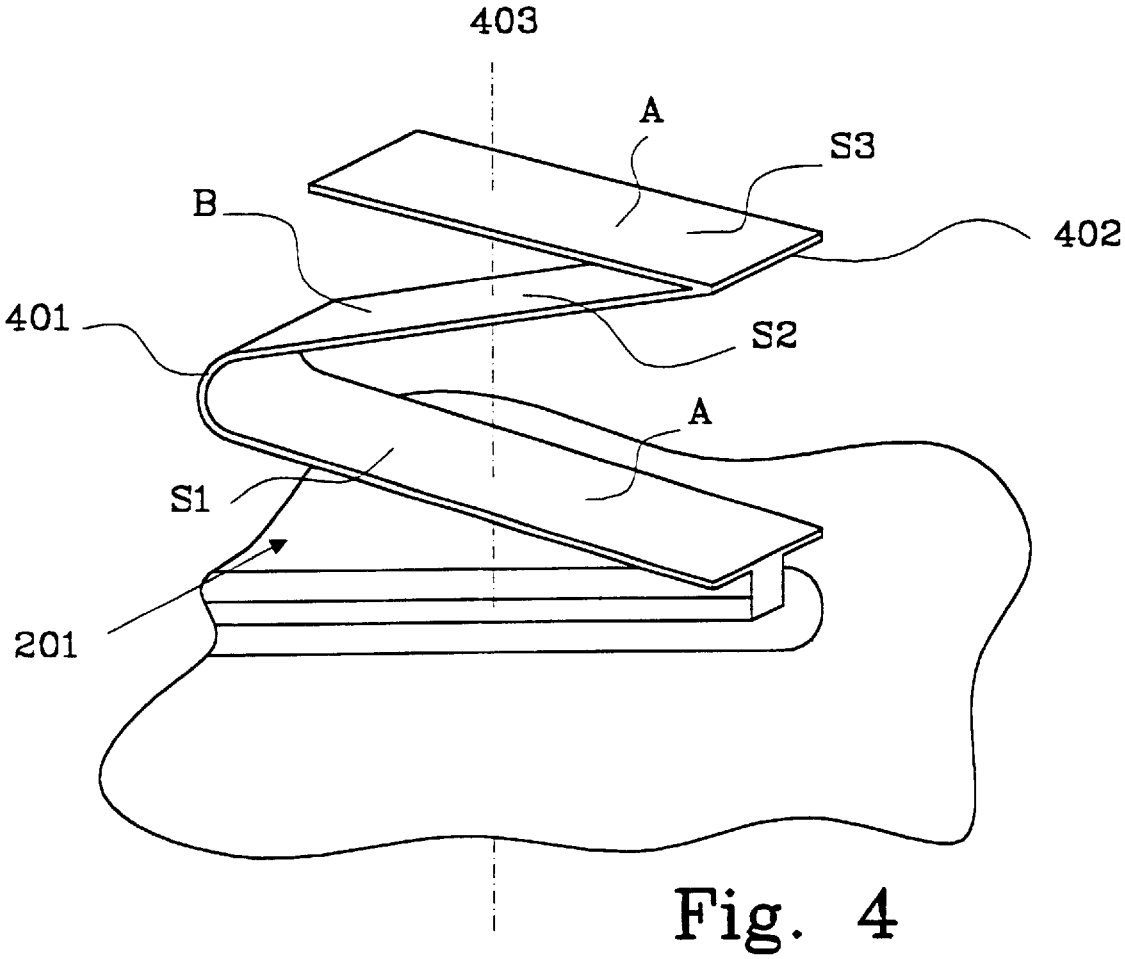
FIG. 4 shows one example of a radiating element according to the invention.

FIG. 4 shows a perspective view of a radiating element according to the invention. The radiating element 201 being shaped like a band and having two bends whereof a first being a soft bend 401 and a second being a sharp bend 402. The radiating element may or may not comprise many more bends, but the zig-zag or accordion structure being essential. The band having a first A and a second B essentially parallel, closely spaced and opposed surfaces. The band being divided by bent portions into a number of sections ($S_n$) along its length. The first surface A of a first section ($S_1$) is facing the first surface A of a second section ($S_2$) and being consecutive to the first section ($S_1$). The second surface B of a section ($S_m$) is facing the second surface B of a consecutive section ($S_{m+1}$).

Figure 5:
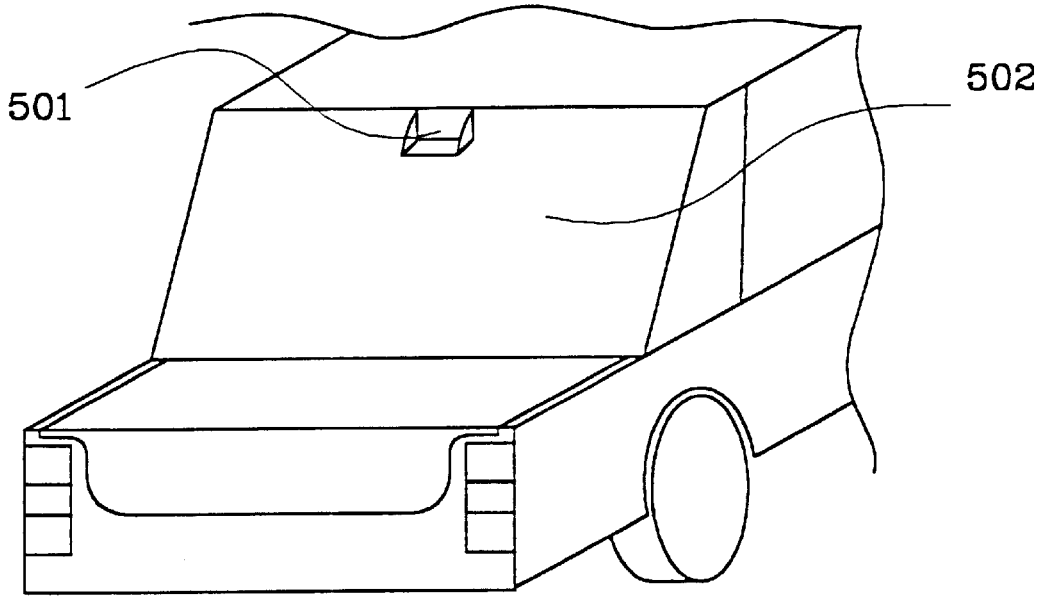
FIG. 5 shows a second preferred embodiment of the present invention.

FIG. 5 shows a second embodiment of the invention. Where the antenna means is integrated into a rear brake light 501 positioned high in the rear windscreen 502.

Figure 6:
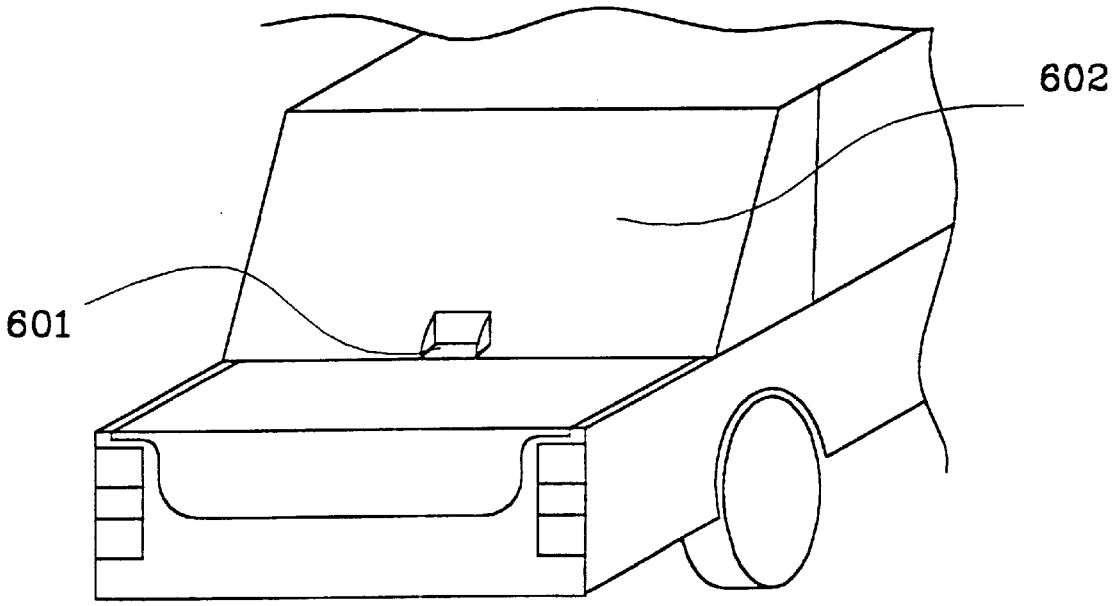
FIG. 6 shows a third preferred embodiment of the present invention.

FIG. 6 shows a third embodiment according to the invention where a box, such as a rear brake light, is positioned low in the rear window. The conductive coating on the sides of the box being connected to ground and to the metallic luggage cover.

The invention being thus described, it will be obvious that the same may be varied in many ways, for instance may more than one radiating element be integrated into the housing. Radiating elements for different systems, such as GPS, GSM, FM, AM etc, may all be combined in many different ways in the housing. Such variations are not to be regarded as a departure from the spirit and scope of the invention, and all such modifications as would be obvious to one skilled in the art are intended to be included within the scope of the following claims.

What is claimed is:

1. An antenna device, arranged for being mounted in a vehicle having a transportation compartment, for transmitting and receiving RF signals in at least one frequency band, comprising:

at least one radiating element having a first end and a second end, and including a feed portion in said first end with said second free end opposite to said first end, feed means for feeding RF signals to said at least one radiating element, a housing being transparent to RF radiation in at least one direction, said housing being arrangeable inside said transportation compartment of said vehicle, said housing including means for suppressing RF radiation in substantially all directions, said suppressing means facing substantially inwards the compartment of said motor vehicle seen from the radiating element, and said radiating element is a broadband radiation element, being arranged in said housing.

2. The antenna device according to claim 1 wherein, said housing comprising conductive surfaces arranged on all sides facing substantially inwards the compartment of said motor vehicle seen from the radiating device, said conductive surfaces being coupled to each other, said conductive surfaces being coupled to ground and, at least one of said conductive surfaces being conductively or capacitively connectable to a larger metal plate.

3. The antenna device according to claim 2 wherein, said radiating element being arranged with said first end in close proximity of at least a first of said conductive surfaces and, said radiating element extends out from said at least first conductive surface.

4. The antenna device according to claim 2 wherein, said larger metal plate is substantially covering at least one side of said compartment.

5. The antenna device according to claim 1 wherein, said radiating element being arranged for receiving and transmitting RF signals in two separate frequency bands.

6. The antenna device according to claim 1 wherein, said at least one radiating element extends in a first axial direction, said housing having a first substantially flat, conductive surface being parallel to said first axial direction, said housing having a second substantially flat, conductive surface being essentially perpendicular to said first axial direction and, said first surface is coupled to said second surface, said housing having a third and fourth substantially flat, conductive, parallel surfaces being essentially perpendicular to said first and second surfaces each being coupled to said first and second surfaces so as to construe a box with three substantially perpendicular sides and, at least one of said first, second, third or fourth surface being arranged to he in conductive or capacitive contact with the roof of said motor vehicle.

7. The antenna device according to claim 6 wherein, said first axial direction being substantially vertical and, said first surface being substantially horizontal.

8. The antenna device according to claim 1 wherein, said radiating element having a substantially accordion shape.

9. The antenna device according to claim 1 wherein, said radiating element is a wide-band radiating element.

10. The antenna device according to claim 9 wherein, a band is formed having a first A and a second B essentially parallel, closely spaced and opposed surfaces, said band being divided by bent portions into a number of sections ($S_n$) along its length, the first surface A of a first section ($S_1$) facing the first surface A of a second section ($S_2$), being consecutive to the fist section ($S_1$), and the second surface B of a section ($S_m$) facing the second surface B of a consecutive section ($S_{m+1}$).

11. The antenna device according to claim 1 wherein, said housing being arranged with the transparent side towards the rear window of said motor vehicle.

12. The antenna device according to claim 1 wherein, said housing being arranged with the transparent side towards the front window of said motor vehicle.

13. The antenna device according claim 1 wherein, at least a second radiating element being arranged in said housing, said second element being arranged to receive and/or transmit RF signals in the GSM, GPS, FM or AM system.

* * * * *